US011486403B1

(12) United States Patent
Chen

(10) Patent No.: US 11,486,403 B1
(45) Date of Patent: Nov. 1, 2022

(54) ROTATIONAL ELECTRIC FAN

(71) Applicant: ShenZhen WeiGuanTong Industry Co., Ltd., Guangdong (CN)

(72) Inventor: Mainan Chen, Guangdong (CN)

(73) Assignee: ShenZhen WeiGuanTong Industry Co., Ltd., Shenzhen (CN)

( * ) Notice: Subject to any disclaimer, the term of this patent is extended or adjusted under 35 U.S.C. 154(b) by 0 days.

(21) Appl. No.: 17/843,686

(22) Filed: Jun. 17, 2022

(30) Foreign Application Priority Data

Dec. 24, 2021 (CN) ..... 202123297111.8

(51) Int. Cl.
*F04D 25/08* (2006.01)

(52) U.S. Cl.
CPC ..... *F04D 25/08* (2013.01)

(58) Field of Classification Search
CPC ..... F04D 19/002–005; F04D 25/08; F04D 25/084; F04D 29/60–601; F04D 29/626; F04D 29/64; F04D 29/644–646
USPC ..... 417/234, 423.14
See application file for complete search history.

(56) References Cited

U.S. PATENT DOCUMENTS 2,129,933 A * 9/1938 Hueglin ..... F04D 29/646 416/169 R
2,260,439 A * 10/1941 Cohen ..... F04D 29/646 403/90
2,451,970 A * 10/1948 Odor ..... F04D 29/668 248/603
2,978,216 A * 4/1961 Sprouse ..... F04D 29/646 248/229.14
4,850,804 A * 7/1989 Huang ..... F16M 13/022 416/246
4,927,120 A * 5/1990 Wang ..... F16M 11/10 248/676
4,927,324 A * 5/1990 Coup ..... F04D 29/703 415/181
5,403,162 A * 4/1995 Chen ..... F04D 25/105 416/246
5,725,356 A * 3/1998 Carter ..... F16M 11/40 D23/382
5,937,537 A * 8/1999 Miller ..... F16M 11/041 34/97
6,293,755 B1 * 9/2001 Fu ..... F16M 11/10 416/246
6,409,475 B1 * 6/2002 Ho ..... F04D 25/06 248/314

(Continued)

*Primary Examiner* — Alexander B Comley
(74) *Attorney, Agent, or Firm* — Dragon Sun Law Firm, PC; Jinggao Li; Nathaniel Perkins

(57) ABSTRACT

The embodiments of the present disclosure provide a rotational electric fan including a fan head and a fan holder, wherein the fan head and the fan holder are connected through a rotational structure. The rotational structure includes: a fitting structure, including a circular cover fitting groove disposed on the fan head and a circular fitting head disposed on the fan holder and cooperating with the circular cover fitting groove, so as to fit the fan head and the fan holder together; a circular spacer, fixed on a surface of the circular fitting head facing toward the fan head and being in interference contact with a surface of the circular cover fitting groove facing toward the circular fitting head, so as to support rotational movement of the fan head relative to the fan holder.

9 Claims, 1 Drawing Sheet

(56) References Cited

U.S. PATENT DOCUMENTS

| | | | | |
|---|---|---|---|---|
| 6,851,933 | B2 * | 2/2005 | Cortez | F04D 29/601 416/246 |
| 2005/0118045 | A1 * | 6/2005 | Elton | F04D 29/601 417/423.15 |
| 2008/0069694 | A1 * | 3/2008 | Hernandez | F04D 29/601 416/63 |
| 2010/0226763 | A1 * | 9/2010 | Gammack | F04D 29/626 415/182.1 |
| 2011/0268567 | A1 * | 11/2011 | Ching | F04D 25/08 415/213.1 |
| 2014/0112791 | A1 * | 4/2014 | Abell | F04D 25/084 416/159 |
| 2016/0230777 | A1 * | 8/2016 | Dao | F04D 17/16 |
| 2018/0017083 | A1 * | 1/2018 | He | F04D 29/601 |
| 2019/0048894 | A1 * | 2/2019 | Ediger | F04D 29/601 |

* cited by examiner

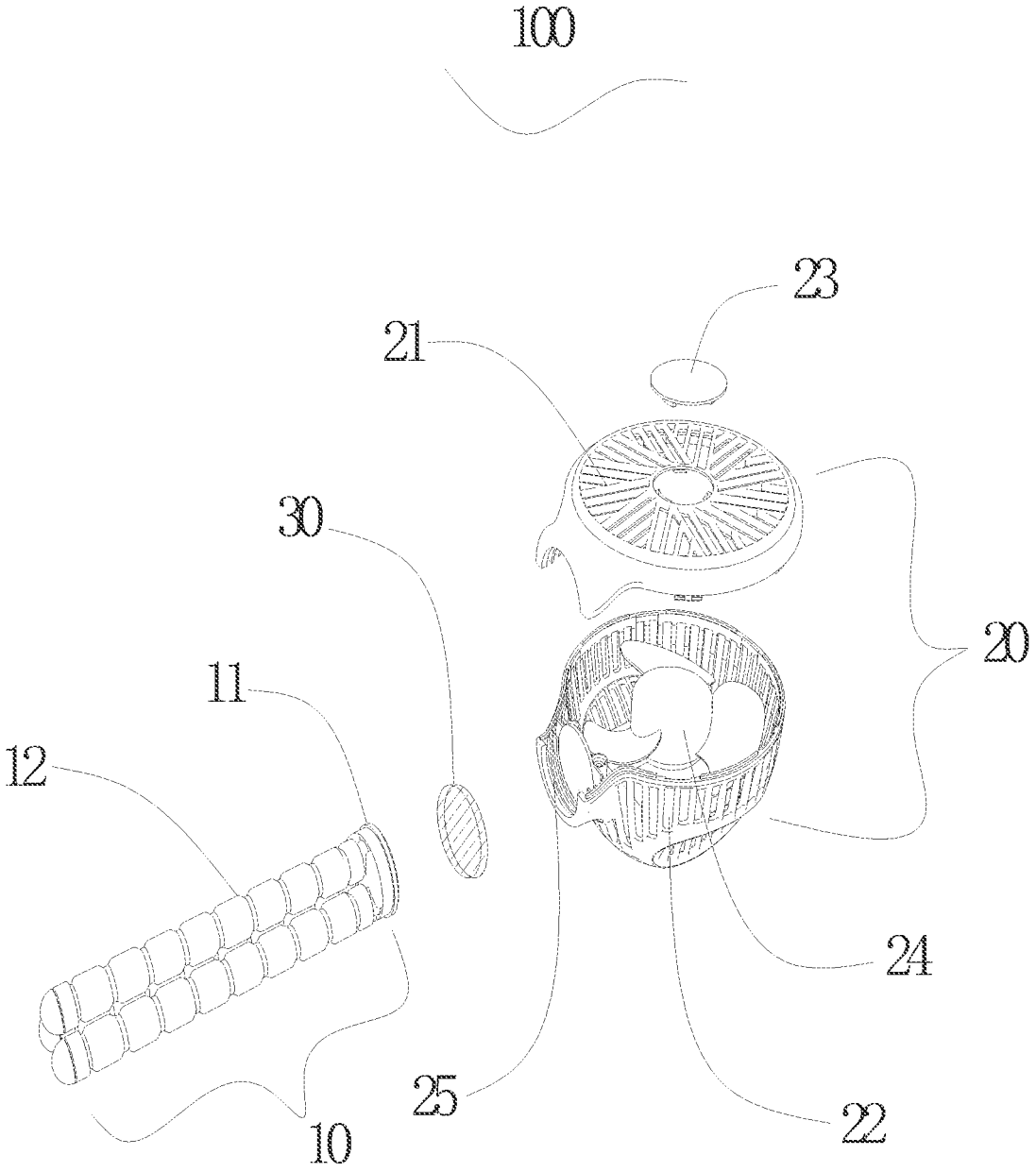
100
23
21
30
20
11
12
24
25
22
10

ROTATIONAL ELECTRIC FAN

CROSS-REFERENCE TO RELATED APPLICATION

This application claims priority from the Chinese patent application 2021232971118 filed Dec. 24, 2021, the content of which is incorporated herein in the entirety by reference.

TECHNICAL FIELD

The present disclosure relates to the field of electric fan technologies, and in particular to a rotational electric fan.

BACKGROUND

Presently, electric fans are common and highly popular air-blowing tools. In the prior art, a household electric fan or an outdoor fan typically includes a fan head and a support frame. In the current market, there are electric fans with a fan head that is manually rotatable relative to the support frame. However, the conventional electric fan is problematic in that the rotation of the fan head relative to the support frame easily causes a rotation part of the fan to be significantly worn and the electric fan may lose its rotation function after the wear exceeds a given degree. Therefore, it is urgent to solve the problem in the prior art.

SUMMARY

Based on the foregoing, it is necessary to provide a rotational electric fan to solve the following problems in the prior art: the rotation of the fan head relative to the support frame easily causes a rotation part of the fan to be significantly worn and the electric fan may lose its rotation function after the wear exceeds a given degree.

The present disclosure adopts the following technical solution.

There is provided a rotational electric fan, including a fan head and a fan holder, wherein the fan head and the fan holder are connected through a rotational structure, and the rotational structure includes: a fitting structure, including a circular cover fitting groove disposed on the fan head and a circular fitting head disposed on the fan holder and cooperating with the circular cover fitting groove, so as to fit the fan head and the fan holder together; a circular spacer, fixed on a surface of the circular fitting head facing toward the fan head and being in interference contact with a surface of the circular cover fitting groove facing toward the circular fitting head, so as to support rotational movement of the fan head relative to the fan holder.

Optionally, a surface of the circular spacer in interference contact with the circular cover fitting groove is a smooth surface made of a wear-resistant material.

Optionally, a surface of the circular cover fitting groove in interference contact with the circular spacer is a smooth surface made of a wear-resistant material.

Optionally, the circular spacer and the circular fitting head are detachably fixed together.

Optionally, the circular spacer and the circular fitting head are fixedly bonded together by glue.

Optionally, a manufacturing material of the circular spacer is a silica gel material.

Optionally, the fan holder includes a plurality of support legs and a disk type rotation seat for fixing the support legs. One surface of the disk type rotation seat is provided with a plurality of fixing holes in one-to-one cooperation with the plurality of support legs. The support legs are rotatable relative to the fixing holes. The other surface of the disk type rotation seat is provided with the circular fitting head.

Optionally, the support leg is manufactured with a bend-deformable material.

Optionally, a surface of the support leg is provided with a multi-sectional anti-slip structure.

Optionally, a side surface of the circular cover fitting groove in contact with the circular fitting head is a smooth surface and a side surface of the circular fitting head in contact with the circular cover fitting groove is a smooth surface.

The embodiments of the present disclosure have the following beneficial effects:

In the rotational electric fan according to the present disclosure, the fan head and the fan holder are fitted together by using a circular cover fitting groove disposed on the fan head and a circular fitting head disposed on the fan holder and cooperating with the circular cover fitting groove, and a circular spacer fixed on a surface of the circular fitting head facing toward the fan head and being in interference contact with a surface of the circular cover fitting groove facing toward the circular fitting head is disposed to support rotational movement of the fan head relative to the fan holder. In this way, a significant wear generated when the fan head rotates relative to the fan holder can be mitigated, thus prolonging the service life of the electric fan.

BRIEF DESCRIPTIONS OF THE DRAWINGS

In order to more clearly describe the technical solutions in the embodiments of the present disclosure or the prior arts, accompanying drawing required for descriptions of the embodiments or the prior art will be briefly introduced below. Apparently, the drawings described below are merely some embodiments of the present disclosure and those skilled in the art may obtain other drawings based on these drawings without making creative work.

FIG. 1 is an exploded view of an entire structure of a rotational electric fan according to an embodiment of the present disclosure.

DETAILED DESCRIPTIONS OF EMBODIMENTS

The technical solutions in the embodiments of the present disclosure will be clearly and fully described in combination with the drawings of the embodiments of the present disclosure. Apparently, the embodiments described herein are merely some embodiments of the present disclosure rather than all embodiments. All other embodiments obtained by those skilled in the art based on these embodiments of the present disclosure without making creative work shall fall within the scope of protection of the present disclosure.

In combination with FIG. 1, an embodiment provides a rotational electric fan 100, including a fan head 20 and a fan holder 10, wherein the fan head 20 and the fan holder 10 are connected through a rotational structure. The rotational structure includes:

a fitting structure, including a circular cover fitting groove 25 disposed on the fan head 20 and a circular fitting head 11 disposed on the fan holder 10 and cooperating with the circular cover fitting groove 25, so as to fit the fan head 20 and the fan holder 10 together;

a circular spacer 30, fixed on a surface of the circular fitting head 11 facing toward the fan head 20 and being in interference contact with a surface of the circular cover fitting groove 25 facing toward the circular fitting head 11, so as to support rotational movement of the fan head relative to the fan holder.

The fan head 20 includes a fan front cover 21 and a fan rear seat 22. A buckle 23 is disposed in a middle portion of the fan front cover 21, and a plurality of fan blades 24 are disposed in the fan rear seat 22. Optionally, the fan front cover 21 and the fan rear seat 22 are independent parts which can be mounted and dismounted, and the fan front cover 21 and the fan rear seat 22 are fixed together through a screw structure.

The circular spacer 30 is shaped like a coin and has an elasticity. The circular spacer 30 can reduce frictional damage to a rotation part when the fan head 20 rotates relative to the fan holder 10. Further, the circular spacer 30 can make rotation easier and extend the service life of the electric fan.

In this embodiment, optionally, a surface of the circular spacer 30 in interference contact with the circular cover fitting groove 25 is a smooth surface made of a wear-resistant material.

The smooth surface of the circular spacer 30 is made of a wear-resistant material to reduce frictional damage to the rotation part.

In this embodiment, optionally, a surface of the circular cover fitting groove 25 in interference contact with the circular spacer 30 is a smooth surface made of a wear-resistant material.

In this case, the smooth surfaces of the circular cover fitting groove 25 and the circular spacer 30 are in mutual interference contact to greatly reduce frictional damage to the rotation part.

In this embodiment, optionally, the circular spacer 30 and the circular fitting head 11 are detachably fixed together. In this case the circular spacer 30 can be conveniently replaced when the circular spacer 30 is severely worn.

In this embodiment, optionally, the circular spacer 30 and the circular fitting head 11 are fixedly bonded together by glue, where the glue may be a strongly-adhesive glue which has obvious fixing effect on plane.

In this embodiment, optionally, a manufacturing material of the circular spacer 30 is a silica gel material, which has heat resistance, wear resistance and dryness and thus is suitable for making the circular spacer 30.

In this embodiment, optionally, the fan holder 10 includes a plurality of support legs 12 and a disk type rotation seat (not shown) for fixing the support legs 12. One surface of the disk type rotation seat is provided with a plurality of fixing holes (not shown) in one-to-one cooperation with the plurality of support legs 12, the support legs 12 are rotatable relative to the fixing holes, and the other surface of the disk type rotation seat is provided with the circular fitting head 11.

In this embodiment, optionally, the support leg 12 is manufactured with a bend-deformable material. The bend-deformable material may be an aluminum alloy material which can bend to deform and restore to normal shape and thus is suitable for making the support legs 12.

In this embodiment, optionally, a surface of the support leg 12 is provided with a multi-sectional anti-slip structure. The multi-sectional anti-slip structure helps a user to fix or bind the support legs 12 to a designated position more stably, and also avoid a slip of the hand of a user.

In this embodiment, optionally, a side surface of the circular cover fitting groove 25 in contact with the circular fitting head 11 is a smooth surface and a side surface of the circular fitting head 11 in contact with the circular cover fitting groove 25 is a smooth surface. In this way, frictional damage can be greatly reduced.

In the rotational electric fan 100 according to the present disclosure, the fan head 20 and the fan holder 10 are fitted together by using a circular cover fitting groove 25 disposed on the fan head 20 and a circular fitting head 11 disposed on the fan holder 10 and cooperating with the circular cover fitting groove 25, and a circular spacer 30 fixed on a surface of the circular fitting head 11 facing toward the fan head 20 and being in interference contact with a surface of the circular cover fitting groove 25 facing toward the circular fitting head 11 is disposed to support rotational movement of the fan head 20 relative to the fan holder 10. In this way, a significant wear generated when the fan head 20 rotates relative to the fan holder 10 can be mitigated, thus prolonging the service life of the electric fan.

The above are only preferred embodiments of the present disclosure and thus cannot be used to limit the scope of protection of the present disclosure. Therefore, equivalent changes made based on the claims of the present disclosure still fall within the scope of protection of the present disclosure.

What is claimed is:

1. A rotational electric fan, comprising a fan head and a fan holder, wherein the fan head and the fan holder are connected through a rotational structure, and the rotational structure comprises:

a fitting structure, comprising a circular cover fitting groove disposed on the fan head and a circular fitting head disposed on the fan holder and cooperating with the circular cover fitting groove, so as to fit the fan head and the fan holder together;

a circular spacer, fixed on a surface of the circular fitting head facing toward the fan head and being in interference contact with a surface of the circular cover fitting groove facing toward the circular fitting head, so as to support rotational movement of the fan head relative to the fan holder;

wherein the fan holder comprises a plurality of support legs and a disk type rotation seat for fixing the support legs, one surface of the disk type rotation seat is provided with a plurality of fixing holes in one-to-one cooperation with the plurality of support legs, the support legs are rotatable relative to the fixing holes, and the other surface of the disk type rotation seat is provided with the circular fitting head.

2. The rotational electric fan of claim 1, wherein a surface of the circular spacer in interference contact with the circular cover fitting groove is a smooth surface.

3. The rotational electric fan of claim 1, wherein the surface of the circular cover fitting groove in interference contact with the circular spacer is a smooth surface.

4. The rotational electric fan of claim 1, wherein the circular spacer and the circular fitting head are detachably fixed together.

5. The rotational electric fan of claim 1, wherein the circular spacer and the circular fitting head are fixedly bonded together by glue.

6. The rotational electric fan of claim 1, wherein a material of the circular spacer is a silica gel material.

7. The rotational electric fan of claim 1, wherein the support legs are manufactured with a bend-deformable material.

8. The rotational electric fan of claim 1, wherein surfaces of the support legs are provided with a multi-sectional anti-slip structure.

9. The rotational electric fan of claim 1, wherein a side surface of the circular cover fitting groove in contact with the circular fitting head is a smooth surface and a side surface of the circular fitting head in contact with the circular cover fitting groove is a smooth surface.

* * * * *